US010373421B2

(12) United States Patent
Pan et al.

(10) Patent No.: US 10,373,421 B2
(45) Date of Patent: Aug. 6, 2019

(54) ELECTRONIC GAMING MACHINE WITH STRESS RELIEVING FEATURE

(71) Applicant: IGT, Las Vegas, NV (US)

(72) Inventors: Georgette M. Pan, Jamestown, RI (US); Neil Abrams, Westport, CT (US)

(73) Assignee: IGT, Las Vegas, NV (US)

( * ) Notice: Subject to any disclaimer, the term of this patent is extended or adjusted under 35 U.S.C. 154(b) by 150 days.

(21) Appl. No.: 15/458,064

(22) Filed: Mar. 14, 2017

(65) Prior Publication Data

US 2018/0268642 A1 Sep. 20, 2018

(51) Int. Cl.
*G07F 17/32* (2006.01)

(52) U.S. Cl.
CPC ..... *G07F 17/3206* (2013.01); *G07F 17/323* (2013.01); *G07F 17/3239* (2013.01); *G07F 17/3244* (2013.01)

(58) Field of Classification Search
CPC ..... G07F 17/3206; G07F 17/323; G07F 17/3239; G07F 17/3244
See application file for complete search history.

(56) References Cited

U.S. PATENT DOCUMENTS

2006/0281543 A1* 12/2006 Sutton ..... G07F 17/32 463/29
2009/0270170 A1* 10/2009 Patton ..... A63F 13/10 463/36
2014/0112556 A1* 4/2014 Kalinli-Akbacak .... G10L 25/63 382/128
2015/0187171 A1* 7/2015 Milligan ..... G07F 17/3227 463/29
2016/0030834 A1* 2/2016 Brown ..... A63F 13/21 463/36
2016/0093154 A1* 3/2016 Bytnar ..... G07F 17/3218 463/25
2017/0287287 A1* 10/2017 Froy ..... G07F 17/3209
2018/0263545 A1* 9/2018 Camporesi ..... H04L 67/22

* cited by examiner

*Primary Examiner* — Corbett B Coburn
(74) *Attorney, Agent, or Firm* — Sage Patent Group

(57) ABSTRACT

A method of operating a gaming machine includes receiving a deposit of wagering credits from a player, determining a threshold stress level for the player, initiating a gaming session, wherein the gaming session includes a plurality of plays of a primary game on the gaming machine, and wherein in at least one of the plurality of plays of the primary game, the gaming machine receives a wager by the player from the deposited wagering credits, monitoring a performance of the player in the gaming session, generating a player stress metric in response to the performance of the player in the gaming session, wherein the player stress metric is indicative of a stress level of the player, comparing the player stress metric to the threshold stress level, and in response to the player stress metric exceeding the threshold stress level, activating a stress relieving feature of the gaming machine.

20 Claims, 12 Drawing Sheets

ELECTRONIC GAMING MACHINE WITH STRESS RELIEVING FEATURE

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Electronic and electro-mechanical gaming machines (EGMs) are systems that allow users to place a wager on the outcome of a random event, such as the spinning of mechanical or virtual reels or wheels, the playing of virtual cards, the rolling of mechanical or virtual dice, the random placement of tiles on a screen, etc.

SUMMARY

This summary is provided to introduce simplified concepts of a transparent display active backlight that are further described below in the Detailed Description. This summary is not intended to identify essential features of the claimed subject matter, nor is it intended for use in determining the scope of the claimed subject matter.

A method of operating a gaming machine according to some embodiments includes receiving a deposit of wagering credits from a player, determining a threshold stress level for the player, initiating a gaming session, wherein the gaming session includes a plurality of plays of a primary game on the gaming machine, wherein in at least one of the plurality of plays of the primary game, the gaming machine receives a wager by the player from the deposited wagering credits, monitoring a performance of the player in the gaming session, generating a player stress metric in response to the performance of the player in the gaming session, wherein the player stress metric is indicative of a stress level of the player, comparing the player stress metric to the threshold stress level, and in response to the player stress metric exceeding the threshold stress level, activating a stress relieving feature of the gaming machine.

The method may further include collecting biofeedback data indicative of a stress level of the player, wherein the player stress metric is generated in response to the biofeedback data.

The biofeedback data may include a skin temperature of the player, a pulse rate of the player, a breathing rate of the player, a skin conductivity of the player and/or a blood oxygen level of the player.

Monitoring performance of the player may include monitoring monetary gains or losses of the player, a total number of wins and losses of the player, and/or a number of losses in a row by the player.

Determining the threshold stress level for the player may include obtaining a baseline stress level for the player and calculating the threshold stress level in response to the baseline stress level.

Determining the threshold stress level for the player includes obtaining the threshold stress level from a player tracking server based on player tracking information provided by the player.

The stress relieving feature may include a striking target, and wherein activating the stress relieving feature includes prompting the player to physically hit the striking target.

The striking target may include a sensor that is configured to detect when the player strikes the striking target, the method further including detecting that the player has struck the striking target.

The method may further include determining whether or not the player has utilized the stress relieving feature, and in response to determining that the player has not utilized the stress relieving feature, terminating the gaming session.

The method may further include determining whether or not the player has utilized the stress relieving feature, and in response to determining that the player has utilized the stress relieving feature, awarding a prize to the player.

The stress relieving feature may include a secondary game, and the method the method may further include collecting biofeedback data indicative of a stress level of the player as part of the secondary game, wherein an outcome of the secondary game is based at least in part in response to the biofeedback data indicating a reduction in the stress level of the player.

The method may further include calculating the player stress metric as part of the secondary game wherein the reduction in the stress level of the player is determined in response to a reduction in the player stress metric.

A gaming machine according to some embodiments includes a processor, a display device, an input device, and a memory device storing a plurality of instructions which, when executed by the processor, cause the processor to operate with the display device and the input device, for a play of a wagering game, to receive a deposit of wagering credits from a player, determine a threshold stress level for the player, initiate a gaming session, wherein the gaming session includes a plurality of plays of a primary game on the gaming machine, wherein in at least one of the plurality of plays of the primary game, the gaming machine receives a wager by the player from the deposited wagering credits, monitor a performance of the player in the gaming session, generate a player stress metric in response to the performance of the player in the gaming session, wherein the player stress metric is indicative of a stress level of the player, compare the player stress metric to the threshold stress level, and in response to the player stress metric exceeding the threshold stress level, activate a stress relieving feature of the gaming machine.

DETAILED DESCRIPTION

Embodiments of the inventive concepts provide electronic gaming machines that include stress relieving features that allow a player to physically relieve stress that may be induced by losing or otherwise performing poorly in a game of chance.

Electronic Gaming Machines

Figure 1A:
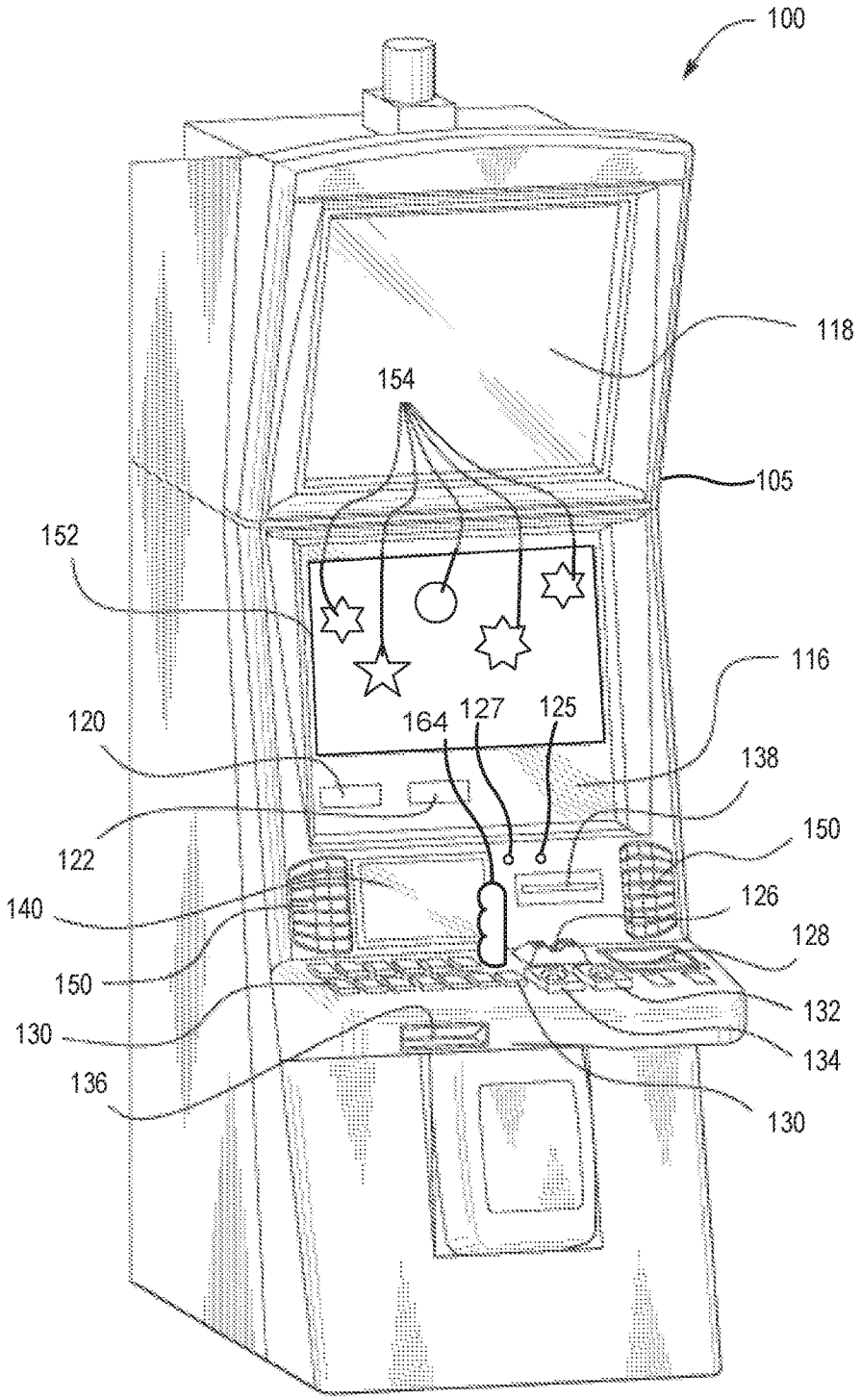
FIG. 1A is a perspective view of an electronic gaming device that can be configured according to some embodiments.
Figure 1B:
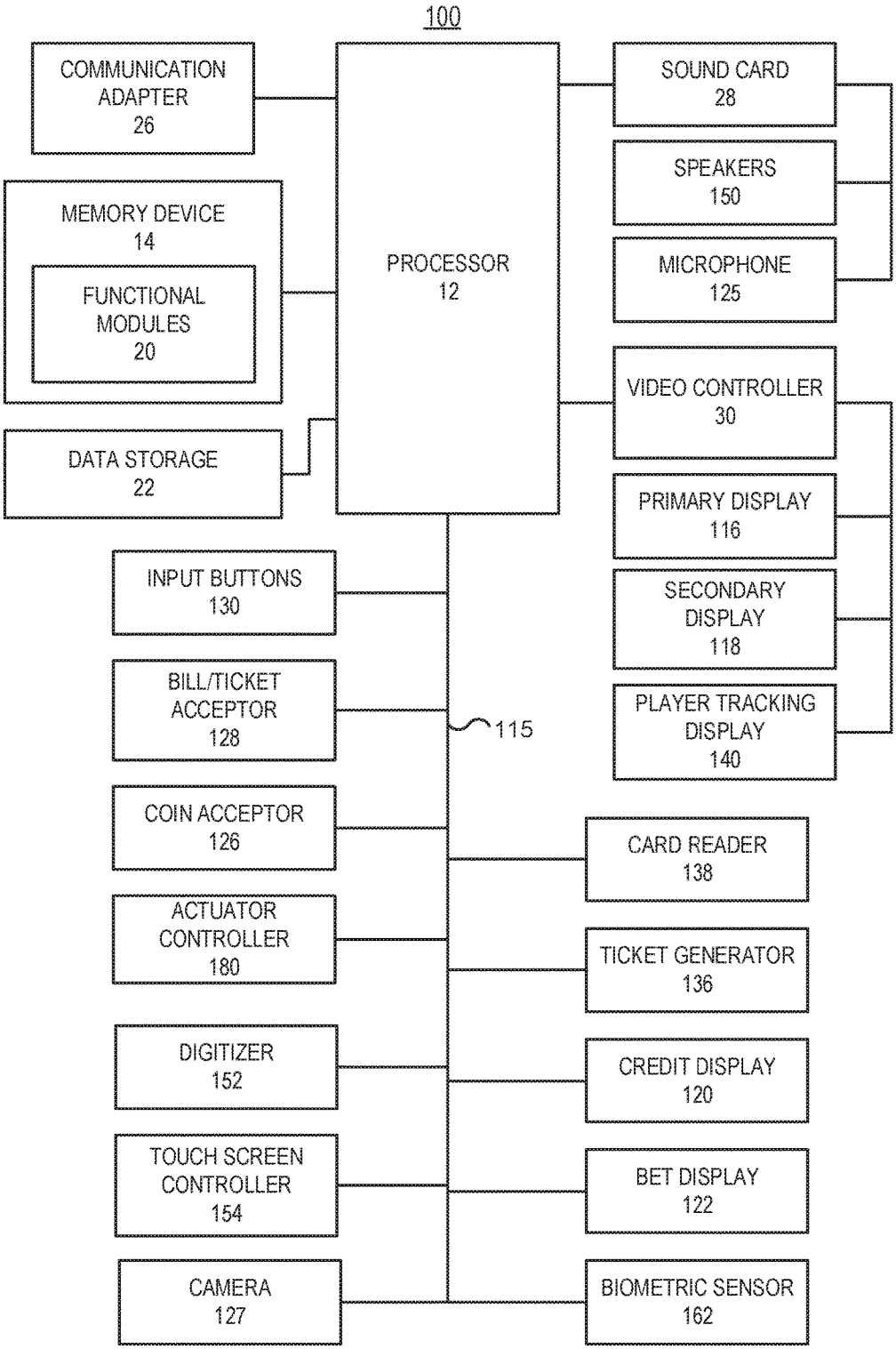
FIG. 1B is a schematic block diagram illustrating an electronic configuration for a gaming device according to some embodiments.
Figure 1C:
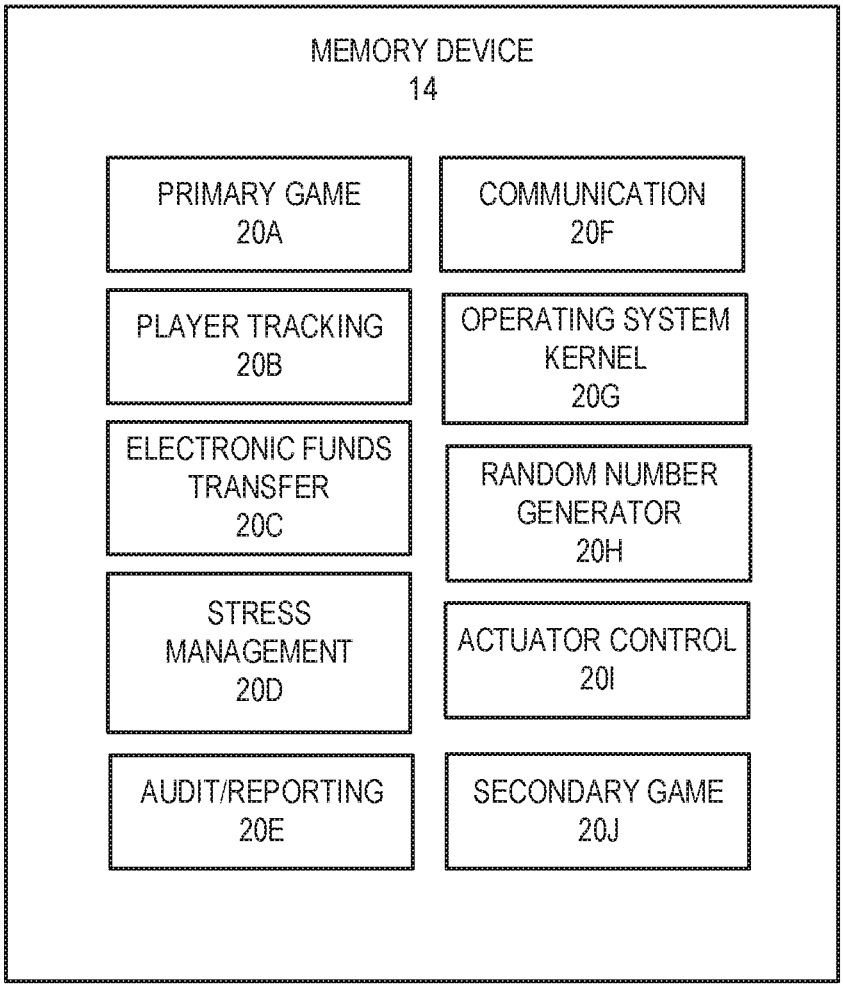
FIG. 1C is a block diagram that illustrates various functional modules of an electronic gaming device according to some embodiments.
Figure 1D:
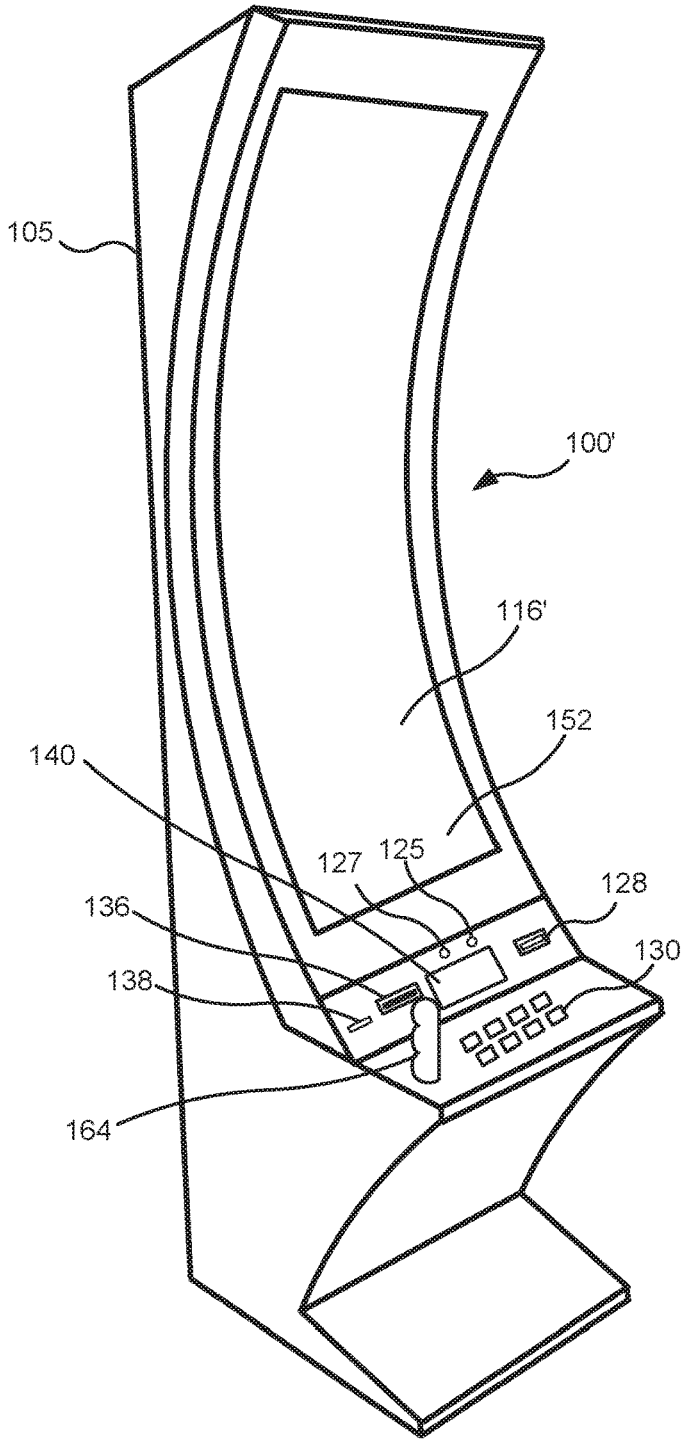
FIG. 1D is a perspective view of an electronic gaming device according to further embodiments.

An example of an electronic gaming machine (EGM) that can host hybrid games according to various embodiments is illustrated in FIGS. 1A, 1B, 1C and 1D, in which FIG. 1A is a perspective view of an EGM 100 illustrating various physical features of the device, FIG. 1B is a functional block diagram that schematically illustrates an electronic relationship of various elements of the EGM 100, FIG. 1C illustrates various functional modules that can be stored in a memory device of the EGM 100, and FIG. 1D is a perspective view of an EGM 100' according to further embodiments. The embodiments shown in FIGS. 1A to 1D are provided as examples for illustrative purposes only. It will be appreciated that EGMs may come in many different shapes, sizes, layouts, form factors, and configurations, and with varying numbers and types of input and output devices, and that embodiments of the inventive concepts are not limited to the particular EGM structures described herein.

EGMs typically include a number of standard features, many of which are illustrated in FIGS. 1A and 1B. For example, referring to FIG. 1A, an EGM 100 may include a support structure, housing or cabinet 105 which provides support for a plurality of displays, inputs, outputs, controls and other features that enable a player to interact with the EGM 100.

The EGM 100 illustrated in FIG. 1A includes a number of display devices, including a primary display device 116 located in a central portion of the cabinet 105 and a secondary display device 118 located in an upper portion of the cabinet 105. It will be appreciated that one or more of the display devices 116, 118 may be omitted, or that the display devices 116, 118 may be combined into a single display device. The EGM 100 may further include a player tracking display 140, a credit display 120, and a bet display 122. The credit display 120 displays a player's current number of credits, cash, account balance or the equivalent. The bet display 122 displays a player's amount wagered.

The player tracking display 140 may be used to display a service window that allows the player to interact with, for example, their player loyalty account to obtain features, bonuses, comps, etc. In other embodiments, additional display screens may be provided beyond those illustrated in FIG. 1A.

The EGM 100 may further include a number of input devices that allow a player to provide various inputs to the EGM 100, either before, during or after a game has been played. For example, the EGM 100 may include a plurality of input buttons 130 that allow the player to select options before, during or after game play. The input buttons 130 may include a game play initiation button 132 and a cashout button 134. The cashout button 134 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 1A and 1B includes a game play activation device in the form of a game play initiation button 132. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may include a touch-sensitive display that includes a digitizer 152 and a touchscreen controller 154 (FIG. 1B). The player may interact with the EGM 100 by touching virtual buttons on one or more of the display devices 116, 118, 140. Accordingly, any of the above described input devices, such as the input buttons 130, the game play initiation button 132 and/or the cashout button 134 may be provided as virtual buttons on one or more of the display devices 116, 118, 140.

Referring briefly to FIG. 1B, operation of the primary display device 116, the secondary display device 118 and the player tracking display 140 may be controlled by a video controller 30 that receives video data from a processor 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processor 12. In some embodiments, however, the credit display 120 and/or the bet display 122 may be driven by the video controller 30.

Referring again to FIG. 1A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touchscreen with an associated touch-screen controller 154 and digitizer 152. The display devices 116, 118, 140 may be of any suitable size, shape, and/or configuration. The display devices 116, 118, 140, may include flat and/or curved display surfaces.

The display devices 116, 118, 140 and video controller 30 of the EGM 100 are generally configured to display one or more game and/or non-game images, symbols, and indicia. In certain embodiments, the display devices 116, 118, 140 of the EGM 100 are configured to display any suitable visual representation or exhibition of the movement of objects; dynamic lighting; video images; images of people, characters, places, things, and faces of cards; and the like. In certain embodiments, the display devices 116, 118, 140 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket dispenser 136 that is configured to generate and provide a ticket or credit slip representing a payout and/or a credit balance. The ticket or credit slip is printed by the EGM 100 when the cashout button 134 is pressed, and typically includes a barcode or similar device that allows the ticket to be redeemed via a cashier, a kiosk, or other suitable redemption system, or to be deposited into another gaming machine. The EGM 100 may further include a bill/ticket acceptor 128 that allows a player to deposit credits in the EGM 100 in the form of paper money or a ticket/credit slip, and a coin acceptor 126 that allows the player to deposit coins into the EGM 100. Other means of depositing or crediting monetary value to the player, such as by electronic funds transfer, wireless payment, etc., may be provided.

While not illustrated in FIG. 1A, the EGM 100 may also include a note dispenser configured to dispense paper currency and/or a coin generator configured to dispense coins or tokens in a coin payout tray.

The EGM 100 may further include one or more speakers 150 controlled by one or more sound cards 28 (FIG. 1B). The EGM 100 illustrated in FIG. 1A includes a pair of speakers 150. In other embodiments, additional speakers, such as surround sound speakers, may be provided within or on the cabinet 105. Moreover, the EGM 100 may include built-in seating with integrated headrest speakers.

In various embodiments, the EGM 100 may generate dynamic sounds coupled with attractive multimedia images displayed on one or more of the display devices 116, 118, 140 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 1B is a block diagram that illustrates logical and functional relationships between various components of an EGM 100. As shown in FIG. 1B, the EGM 100 may include a processor 12 that controls operations of the EGM 100. Although illustrated as a single processor, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor 12 may be variously referred to as a "controller," "microcontroller," "microprocessor" or simply a "computer." The processor may further include one or more application-specific integrated circuits (ASICs).

Various components of the EGM 100 are illustrated in FIG. 1B as being connected to the processor 12. It will be appreciated that the components may be connected to the processor 12 through a system bus 115, a communication bus and controller, such as a USB controller and USB bus, a network interface, or any other suitable type of connection.

The EGM 100 further includes a memory device 14 that stores one or more functional modules 20. Various functional modules 20 of the EGM 100 will be described in more detail below in connection with FIG. 1D.

The memory device 14 may store program code and instructions, executable by the processor 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (MRAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage device 22 may store program data, player data, audit trail data or any other type of data. The data storage device 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touchscreens, trackballs, touchpads, wheels, and wireless communication devices. In some embodiments, internal or external peripheral devices may communicate with the processor through a universal serial bus (USB) hub (not shown) connected to the processor 12. U.S. Patent Application Publication No. 2004/0254014 describes a variety of EGMs including one or more communication ports that enable the EGMs to communicate and operate with one or more external peripherals.

In some embodiments, the EGM 100 may include a sensor, such as a camera 127 in communication with the processor 12 (and possibly controlled by the processor 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processor 12 may incorporate that image into the primary and/or secondary game as a game image, symbol or indicia.

The EGM 100 may further include a microphone 125 connected to the sound card 28 and arranged to pick up sounds generated by the player.

Still referring to FIGS. 1A and 1B, the EGM 100 may include one or more biometric sensors 162 that can be used to help gauge an emotional state of the player. The biometric sensor 162 may include, for example, a pulse monitor, a respiratory monitor, a blood oxygen level monitor, a body temperature monitor, a stress monitor, etc., that is mounted, for example, on a handle or joystick 164 attached to the EGM 100. The biometric sensor 162 may include one or more electrodes that, when contacted by the player, allow the biometric sensor 162 to measure one or more physiological conditions of the player that may indicate stress, such as increased body or skin temperature, increased pulse rate, increased respiratory rate, stress-related electrical conductance fluctuations in the player's skin, changes in blood oxygen level, etc. In some embodiments, the output of the biometric sensor 162 may be provided to the processor 12, which may generate a metric, referred to herein as a "player stress metric," that indicates a level of stress experienced by the player. In addition to the output of the biometric sensor 162, the player stress metric may take into account data collected from the microphone 125 and/or the camera 127. In some embodiments, the camera 127 maybe configured to capture infrared images of the player that can be used to detect changes in skin or body temperature of the player. In some embodiments, images captured by the camera 127 and/or sounds captured by the microphone 125 can be analyzed to identify changes in the respiratory rate of the player. In some embodiments, the player's voice can be monitored using the microphone 125 to detect changes in voice pitch that may indicate an increased level of stress. Similarly, the player's movements can be tracked and analyzed to detect changes, such as increased frequency or speed of movements, that may indicate that the player is experiencing an increased level of stress. The player stress metric may also take into account the player's performance at the game. For example, the player stress metric may take into account a player's overall monetary gains or losses, the player's total number of wins and losses, a number of losses in a row (i.e., the length of a current losing streak), or other factors. The player stress metric will be discussed in more detail below.

The EGM 100 may further include an actuator controller 180. The actuator controller 180, which is controlled by the processor 12, controls one or more actuators that can operate one or more stress relieving features of the EGM 100, as discussed in more detail below.

Various functional modules of that may be stored in a memory device 14 of an EGM 100 are illustrated in FIG. 1C. Program code contained in the functional modules controls the processor 12 to perform the functions described herein. Referring to FIG. 1C, the EGM 100 may include in the memory device 14 a primary game module 20A that includes program instructions and/or data for operating a wagering game as described herein. The EGM 100 may further include a player tracking module 20B that keeps track of the identity and other information related to the current player, an electronic funds transfer module 20C that manages transfer of credits to/from the player's account, a stress management module 20D that generates and processes the player stress metric described herein, an audit/reporting module 20E that generates audit reports of games played on the EGM 100, a communication module 20F that manages network and local communications of the EGM 100, an operating system 20G and a random number generator 20H. The electronic funds transfer module 20C communicates with a back end server or financial institution to transfer funds to and from an account associated with the player. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

The EGM 100 may further include an actuator control module 201 for controlling one or more of the stress relieving features described below. The EGM 100 may also include a secondary game module 20J that controls operation of a stress-relieving secondary game that is designed to reduce a stress level of the player.

The stress management module 20J may receive inputs from the primary game module 20A and/or from various sensor devices, such as the biometric sensor(s) 162, the camera 127 and/or the microphone 125, and generate the player stress metric based on those inputs. The stress management module 20J may also compare the player stress metric to a threshold stress level and activate a stress relieving feature of the EGM 100 as described herein.

FIG. 1D illustrates a standalone EGM 100' having a different form factor from the EGM 100 illustrated in FIG. 1A. In particular, the EGM 100' is characterized by having a large, high aspect ratio, curved primary display device 116' provided in the cabinet 105, with no secondary display device. The primary display device 116' may include a digitizer 152 to allow touchscreen interaction with the primary display device 116'. The EGM 100' may further include a player tracking display 140, a plurality of input buttons 130, a bill/ticket acceptor 128, a card reader 138, and a ticket generator 136. The EGM 100' may further include one or more cameras 127 to enable facial recognition and/or motion tracking. The EGM 100' may also include a handle or joystick 164 on which electrodes or other elements of the biometric sensor(s) 162 may be located.

EGM Network

Figure 2:
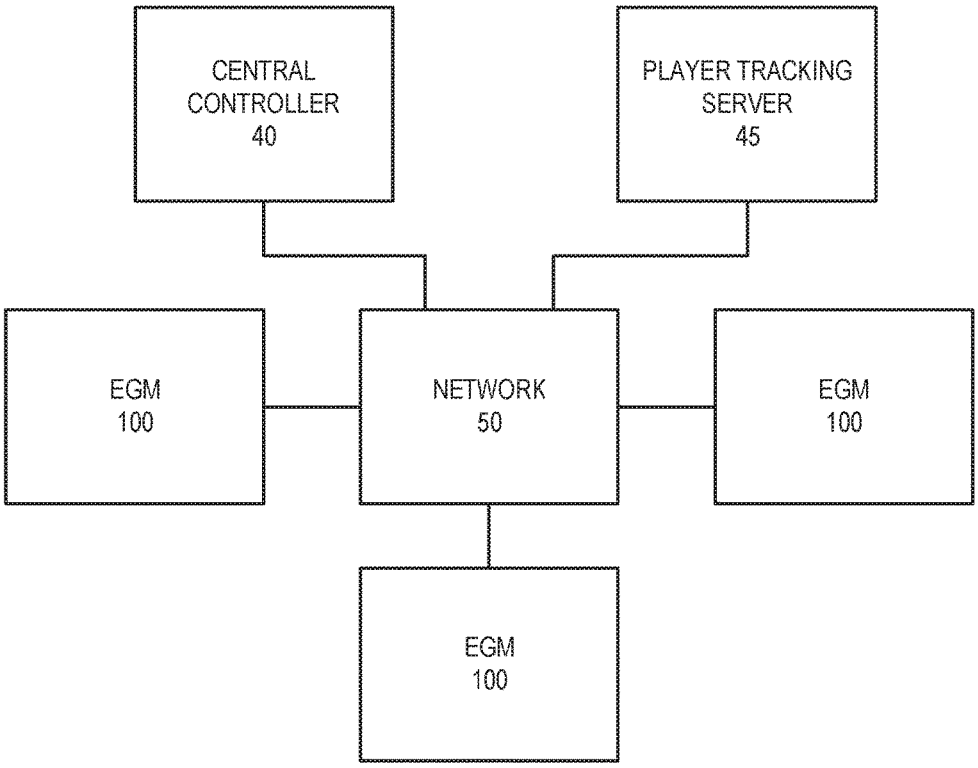
FIG. 2 is a schematic block diagram illustrating a network configuration for a plurality of gaming devices according to some embodiments.

Referring to FIG. 2, one or more EGMs 100 may be in communication with each other and/or at least one central controller 40 through a data network 50. The data network 50 may be a private data communication network that is operated, for example, by the gaming facility that operates the EGM 100. Communications over the data network 50 may be encrypted for security. The central controller 40 may be any suitable server or computing device which includes at least one processor and at least one memory or storage device. In different such embodiments, the central controller 40 is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central controller 40 is designed to transmit and receive events, messages, commands or any other suitable data or signal between the central controller 40 and each of the individual EGMs 100. The central controller 40 is operable to execute such communicated events, messages or commands in conjunction with the operation of the central server. It should be appreciated that one, more or each of the functions of the central controller 40 as disclosed herein may be performed by one or more EGM processors. It should be further appreciated that one, more or each of the functions of one or more EGM processors as disclosed herein may be performed by the central controller 40.

A player tracking server 45 may also be connected through the data network 50. The player tracking server 45 may manage a player tracking account that tracks the player's gameplay and spending, manages loyalty awards for the player, manages funds deposited or advanced on behalf of the player, and other functions. In some embodiments of the inventive concepts, the player tracking server 45 also keeps track of a player's baseline stress level, and may also keep track of a threshold stress level that is associated with a particular player.

Stress Relieving Features

Although gaming is considered by most players to provide relaxation and enjoyment, players of electronic gaming machines, and in particular players of electronic wagering machines, may experience frustration or stress when they lose. For example, players may experience frustration or stress if they encounter an extended losing streak or if they lose an amount that is greater than expected. Players may respond to this stress in different ways. For example, some players may quit playing, while others may physically take their frustrations out on the machine, such as by punching, kicking or shaking the machine. In either case, the result is not beneficial to the game operator, as it is in the best interest of the game operator for the player to have a relaxing, enjoyable, and extended gameplay experience. Moreover, punching, kicking, and/or shaking can damage a conventional electronic gaming machine, resulting in losses to the game operator and potentially in liability to the player.

Embodiments of the inventive concepts provide electronic gaming machines that include stress relieving features that allow a player to physically and/or mentally relieve stress that may be induced by losing, or otherwise performing poorly, in a game of chance. In some embodiments, the stress relieving features may, for example, include physical features that the player is allowed to punch or hit as a stress relieving action, which may allow the player to "take their frustrations out" on the machine itself. For example, as discussed below, the stress relieving feature may take the form of a punching bag that the player can hit, a "whack-a-mole" type game in which the player tries to hit pop-up targets, a squeeze ball or handle that the player can squeeze, etc.

In other embodiments, the stress relieving feature may include a stress relieving game that the player is invited to play, as described in more detail below. The stress relieving game may incorporate biofeedback to help the player reduce his or her stress level before the player is allowed to continue the primary game.

The electronic gaming machine may calculate a player stress metric that corresponds to an actual or predicted stress level of the player. The player stress metric may be calculated based on the player's performance at the game. For example, the player stress metric may be calculated according to a formula that takes into account a player's win/loss history, a total amount lost in the current session, total number of game losses, a total amount lost by the player at the particular gaming machine or type of game, a total amount lost by the player over a given time period, previous stress metric determinations, or other factors. The player stress metric may also be based on biofeedback obtained from the player during gameplay.

In some embodiments, the player stress metric may be calculated as a weighted combination of a plurality of factors, including player performance factors and/or biofeedback data factors. For example, the player stress metric may be calculated based on player performance factors according to Equation [1] as follows:

$$PSM=w_1PF_1+w_2PF_2+\ldots+w_nPF_n \quad [1]$$

where PSM is the player stress metric, $w_n$ is the nth weight and $PF_n$ is the nth player performance factor, such as total monetary losses, total game losses, win/loss ratio, etc.

In other embodiments, the player stress metric may take into account biofeedback data factors, such as the skin temperature of the player, the pulse rate of the player, the breathing rate of the player, the skin conductivity of the player, the blood oxygen level of the player, etc. In that case, the player stress metric may be calculated according to Equation [2] as follows:

$$PSM=w_1BF_1+w_2BF_2+\ldots+w_mBF_n \quad [2]$$

where $w_m$ is the mth weight and $BF_m$ is the mth biofeedback data factor. In still further embodiments, the player stress metric may be calculated using an equation that takes into account both player performance factors and biofeedback data factors according to Equation [3] as follows:

$$PSM=w_1PF_1+\ldots+w_nPF_n+w_{n+1}BF_1+\ldots+w_{n+m}BF_m \quad [3]$$

It will be appreciated that the player stress metric can be calculated in ways other than a weighted linear function as shown. For example, the player stress metric may be calculated according to a non-linear function, a time-varying function, an unweighted function, etc.

A stress relieving feature may be activated when the player stress metric exceeds a predetermined threshold stress level, which may be different from player to player. In some embodiments, a baseline stress level can be generated for a player, and the threshold may be established based on the baseline stress level. For example, the threshold stress level for the player may be set such that a stress relieving feature of an EGM will be activated when the player stress metric for the player exceeds a defined percentage, e.g., 150%, of the player's baseline stress level.

Player stress information, such as a player's baseline stress level and/or threshold stress level, may be stored by the player tracking server 45 for use in subsequent gaming sessions. Thus, any electronic gaming machine that has access to the player tracking server 45 can obtain the player's baseline stress level. Moreover, the electronic gaming machine can provide feedback to the player tracking server 45 of the player's stress levels and/or utilization of stress relieving features of the gaming machine.

In still further embodiments, the stress relieving feature of an electronic gaming machine may be activated by the player on demand. For example, an electronic gaming machine may include a special button or input that allows the player to activate a stress relieving feature when the player feels his or her stress level rising.

Figure 3A:
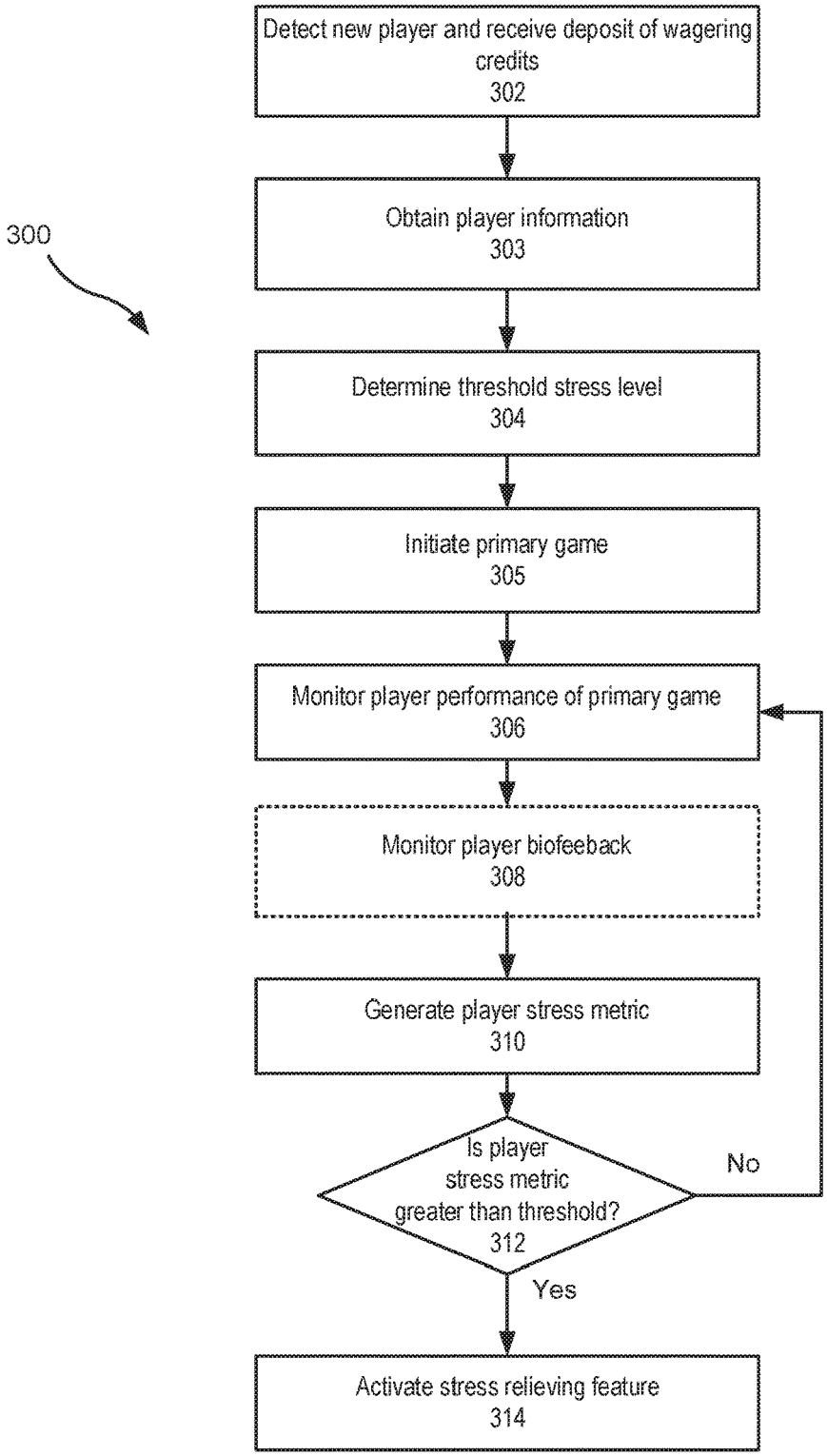
FIGS. 3A, 3B and 4 are process flow diagrams illustrating operations of systems/methods according to various embodiments.

FIG. 3A is a flowchart illustrating operations 300 that may be performed by an electronic gaming machine according to some embodiments. As shown therein, the operations begin when the EGM 100 detects that a new player has started a gaming session at the EGM 100 (block 302). The new player may be detected, for example, when a player deposits credits into the EGM 100, such as by inserting cash or a credit voucher into the EGM 100. The EGM 100 may also detect the presence of a new player when the player swipes or scans a player tracking card, or activates a player tracking feature using a mobile phone, etc. If a player tracking feature is used, player credits may be transferred to the EGM 100 via electronic funds transfer from an account associated with the player's tracking account. If the player is identified, such as by use of a player tracking card or mobile phone, the EGM 100 may obtain player information from the player tracking server 45 through the network 50 (block 303).

The EGM 100 then determines a threshold stress level for the player (block 304). The player information obtained from the player tracking server 45 may include a baseline stress level associated with the player. If the player is not identified to the EGM 100, or of the player tracking server 45 does not have a baseline stress level associated with the player, the EGM 100 may assign a default baseline stress level to the player. The EGM 100 may then calculate a threshold stress level for the player. In some embodiments, the player tracking server 45 may provide the threshold stress level to the EGM 100.

The EGM 100 then initiates a primary wagering game (block 305), which may include, for example, a reel-based slot machine, a matching game, a roulette game, a poker game, etc. Typically, a wagering game is initiated when the player makes a wager and actuates a gameplay button, lever, arm, etc. A gaming session typically involves a plurality of iterations, instances or plays of a primary game on the gaming machine. In at least one of the plays of the primary game, the player places a wager from the deposited wagering credits. However, one or more of the plays of the primary game may be "free plays" that may be awarded to the player from time to time.

During the gaming session, the EGM 100 monitors the player's performance, such as the players total wins and losses, total amounts wagered, total amounts won, etc. (block 306). The EGM 100 may also optionally monitor biofeedback information obtained from the player during the gaming session (block 308). As noted above, biofeedback information may obtained from the player in a number of ways. For example, the EGM 100 may use a camera 127 to monitor movements of the player and/or an eye tracking device to monitor the player's eye movement. The EGM 100 may further monitor the player's voice using the microphone 125. The EGM 100 may also monitor the stress level of the player using a biometric input device 162 as described above.

Based on the gameplay information and optionally on the biometric feedback data obtained from the player, the EGM 100 calculates a player stress metric (block 310). The EGM 100 compares the player stress metric to the threshold stress level associated with the player (block 312). If the player stress metric is less than the threshold stress level, operations return to block 306, and the EGM 100 continues to monitor the player's performance.

However, if the player stress metric is greater than the threshold stress level, the EGM 100 may activate a stress relieving feature (block 314).

Figure 3B:
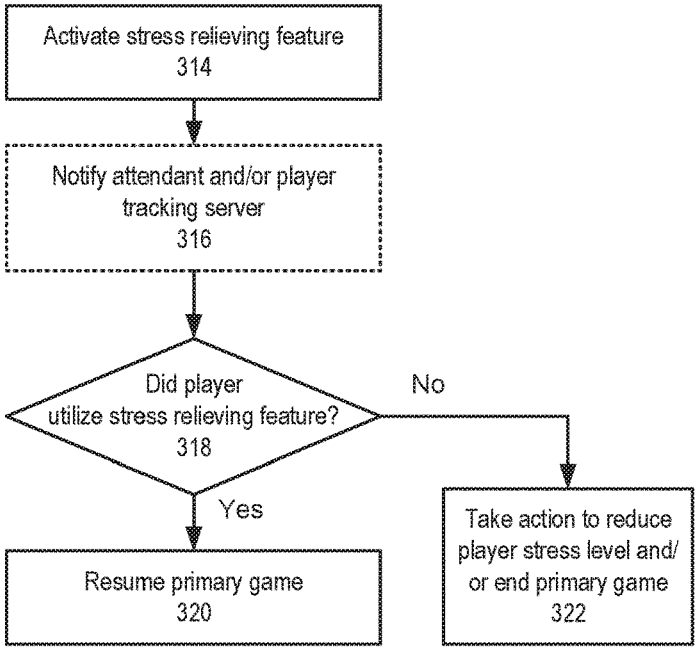

FIG. 3B illustrates operations of an EGM 100 according to some embodiments once a stress relieving feature has been activated at block 314. As shown therein, in some embodiments, after activation of the stress relieving feature at block 314, the EGM 100 may notify an attendant at the gaming facility at which the EGM 100 is located so that the game operator is made aware that a player has exceeded their threshold stress level (block 316). The EGM 100 may also report the activation of the stress relieving feature to the player tracking server 45. The player tracking server 45 may adjust the players baseline stress level in response to the activation of the stress relieving feature.

The EGM 100 may determine if the player has utilized the stress relieving feature (block 318). If the player does not utilize the stress relieving feature, the EGM 100 may take a responsive action, such as terminating the player's session (block 322). In some embodiments, the EGM 100 may take other actions intended to reduce the player's stress level, such as slowing the pace of the game, reducing a wagering denomination, playing relaxing music, displaying soothing images, etc.

If the player does utilize the stress relieving feature, the EGM 100 may resume the primary wagering game (Block 320).

In some embodiments, the EGM 100 may reward the player for utilizing the stress relieving feature. For example, the EGM 100 may provide a free play, a credit, reward points, or other prize to the player for utilizing the stress relieving feature. This may induce the player to utilize the stress relieving feature.

Figure 4:
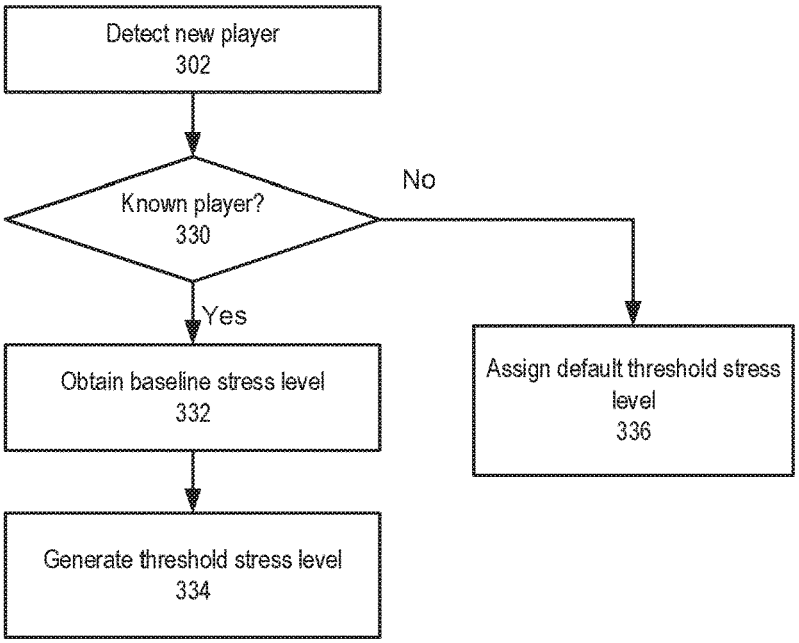

FIG. 4 illustrates the generation of a threshold stress level after a new player has been detected at block 304. Once a new player is detected, the EGM 100 may determine if the player is known to the gaming establishment (block 330).

Typically, a player is identified when the player swipes or inserts a player tracking card that includes a unique identifier. The identifier is transmitted to the player tracking server 45, which identifies the player associated with the player tracking card. However, players can be identified through other means, such as facial recognition, voice recognition, etc. If the player is known, the EGM 100 obtains a baseline stress level for the player from the player tracking server 45 (block 332) and generates a threshold stress level based on the baseline stress level (block 334). In other embodiments, the player tracking server 45 may provide the baseline stress level directly to the EGM 100.

If the player is not recognized, the EGM 100 may assign a default threshold stress level to the player (block 336).

Figure 5:
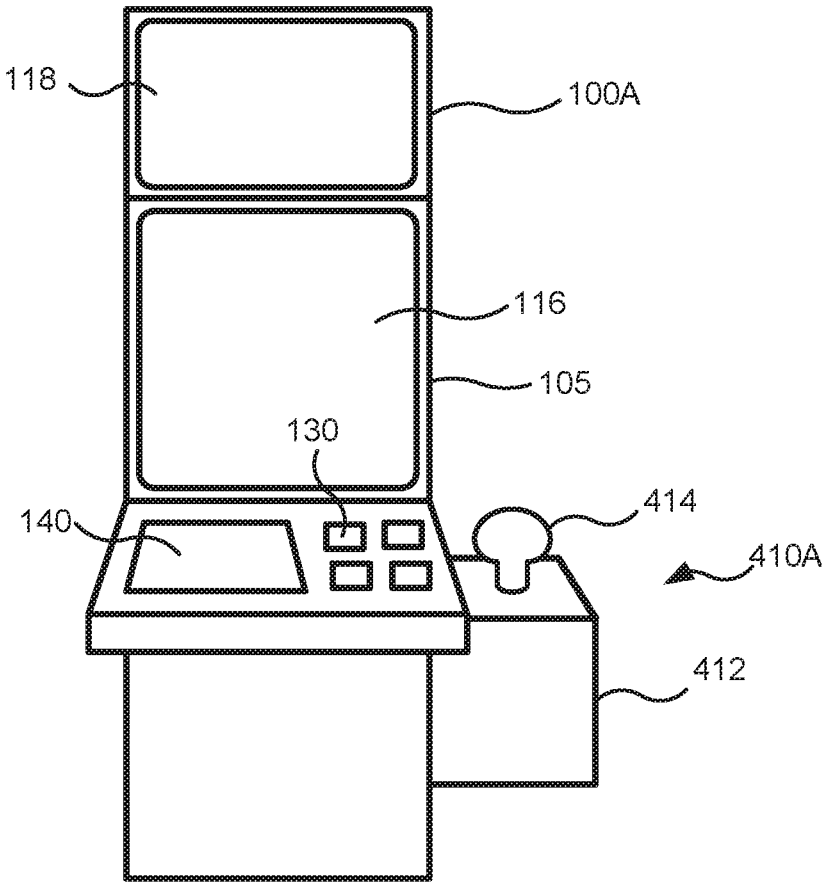
FIG. 5 illustrates an electronic gaming machines configured according to some embodiments.

FIG. 5 illustrates an EGM 100A configured according to some embodiments. As shown in FIG. 5, the EGM 100A may include a cabinet 105, primary and secondary displays 116, 118, a player tracking display 140, and input buttons 130. In addition to the features illustrated in FIG. 1A (some of which may be omitted), the EGM 100A includes a stress relieving device 410A that includes a housing 412 mounted on the EGM 100A and a durable but soft striking target 414, such as a punching bag or squeeze ball, mounted on the housing 412. It will be appreciated that the stress relieving device 410A may not be mounted onto the EGM 100A, but may be provided as a standalone device that is in proximity to the EGM 100A. The striking target 414 may be provided as a pop-up device that is normally hidden, but that pops up when the stress relieving feature is activated. When the stress relieving feature is activated, the striking target 414 may pop up, and the EGM may display a video message and/or play an audio message to the player inviting the player to hit the striking target (e.g., "Let 'em have it!"). By hitting the striking target, the player may let out some pent up aggression and frustration without hurting the EGM 100A itself.

In other embodiments, the striking target 414 may be permanently present and available to the player. In that case, when the stress relieving feature is activated, the EGM 100 may display a video message and/or play an audio message to the player inviting the player to hit the striking target.

Figure 6A:
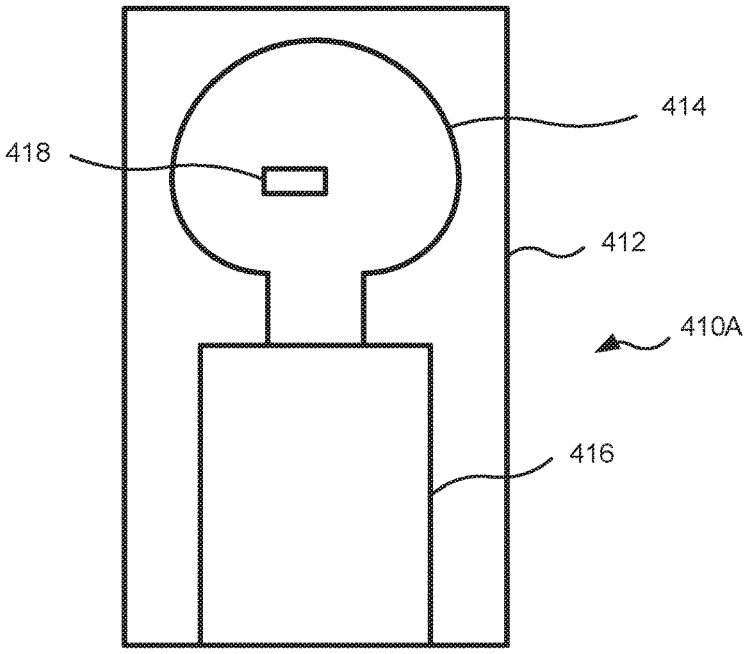
FIGS. 6A and 6B are detail cutaway views of a stress relieving device according to some embodiments.
Figure 6B:
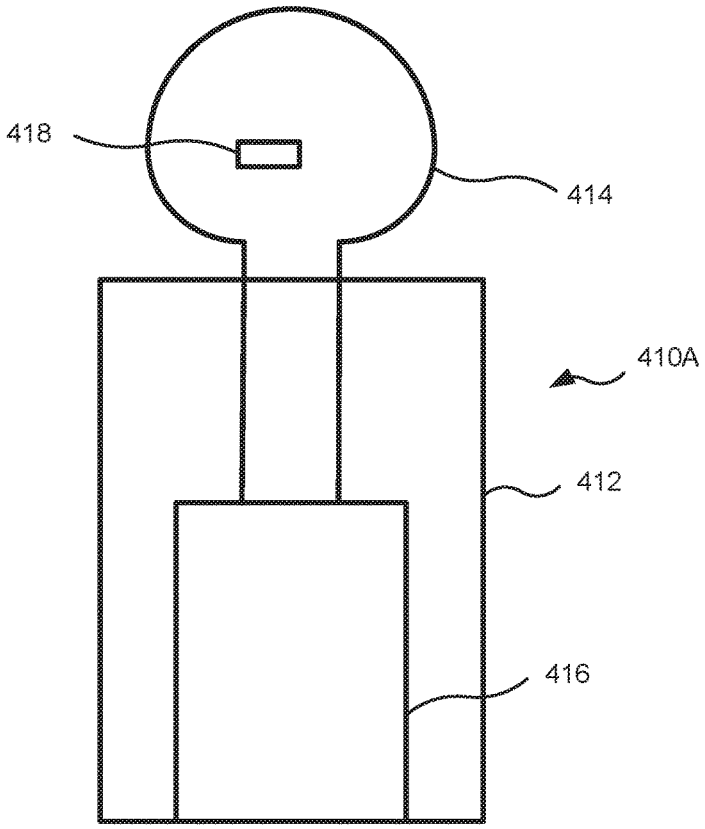

FIGS. 6A and 6B are cutaway views illustrating some internal portions of the stress relieving device 410A when the striking target 414 is in a retracted or stowed position (FIG. 6A) and an extended or deployed position (FIG. 6B). As shown in FIG. 6A, the striking target 414 may be mounted on an actuator 416, such as a linear actuator, within the housing 412. When the stress relieving device 410A is activated, the EGM 100A may cause the actuator 416 to move the striking target up from a stowed position and out of the housing 412 into a deployed position in which the player may hit the striking target 414.

One or more sensors 418, such as contact sensors, pressure sensors, strain gauges, etc., may be mounted on or in the striking target 414. The sensor(s) 418 may detect when the striking target 414 is hit by the player and/or how hard the player hit the striking target 414. This information may be reported to the processor 12 by the stress relieving device 410A, which may use the information to update the player stress metric and/or the player's threshold stress level. For example, if the player hits the striking target 414 harder or more times than usual, the EGM 100A may lower the player's threshold stress level so that the stress relieving device 410A will be activated sooner the next time.

Figure 7:
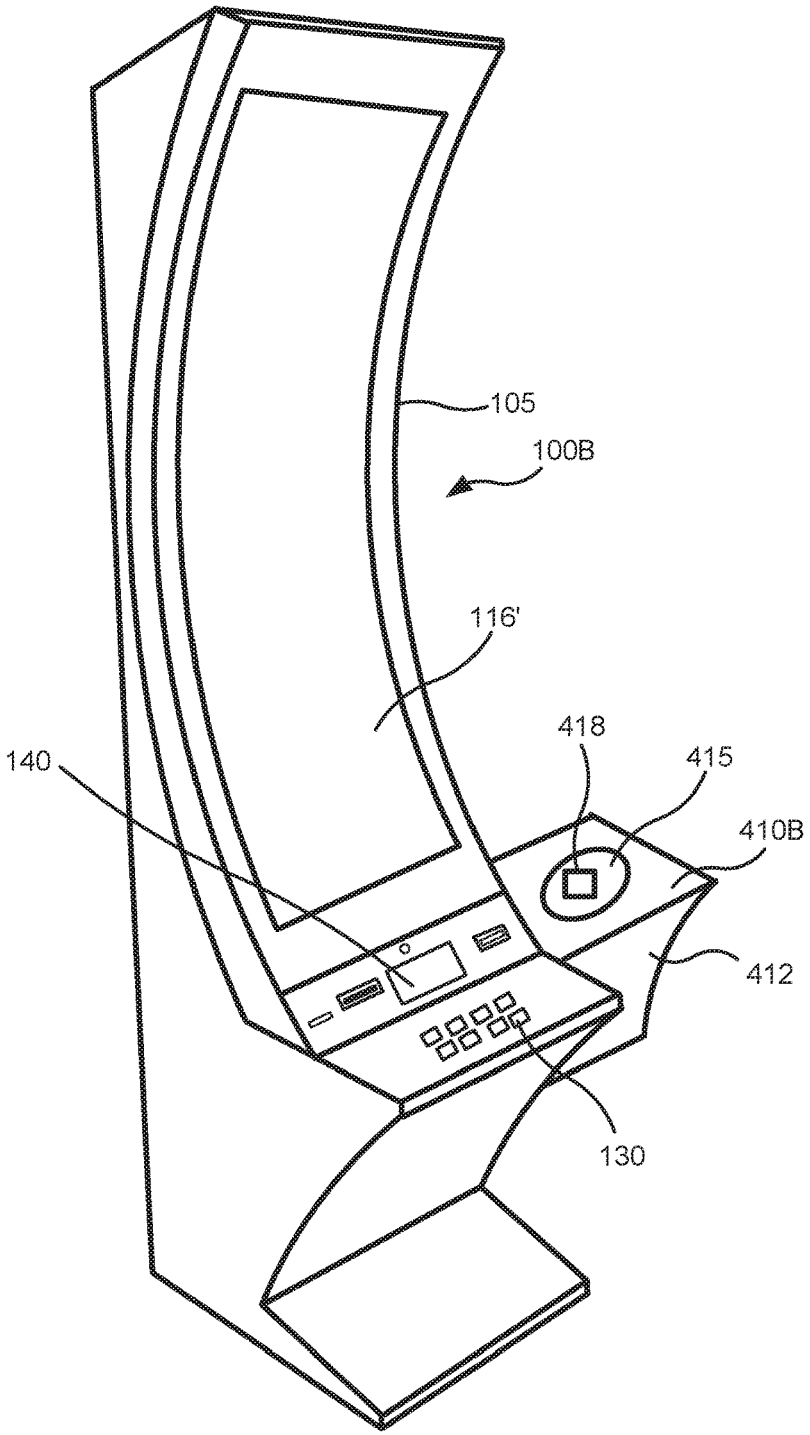
FIGS. 7 and 8 illustrate electronic gaming machines configured according to various embodiments.

FIG. 7 illustrates an EGM 100B according to further embodiments. The EGM 100B includes a stress relieving device 410B that is attached to the housing of the EGM 100B. The stress relieving device 410B may include a striking surface 415 on the housing 412. The striking surface 415 may be a padded surface that is capable of withstanding strikes by the player, and may include a sensor 418 on or in the striking surface 415 to detect when a player hits the striking surface 415.

Figure 8:
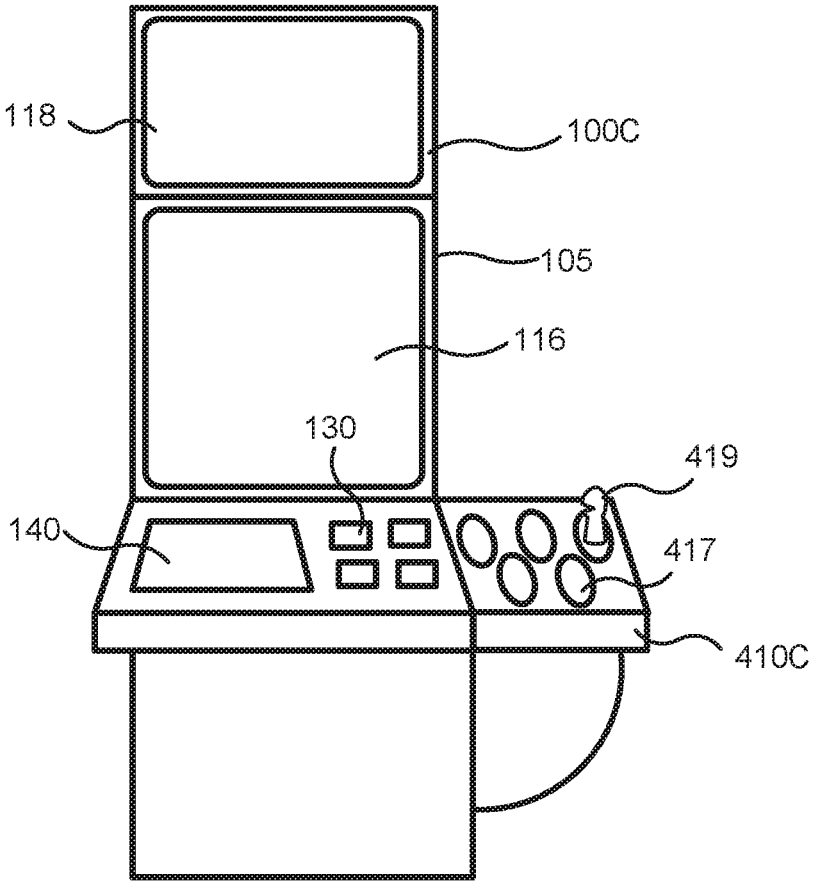

FIG. 8 illustrates an EGM 100C according to still further embodiments. The EGM 100C includes a stress relieving device 410C that includes a plurality of openings 417 through which a plurality of striking targets 419 that comprise dummies may be deployed. The striking targets 419 may be controlled to pop up one or more at a time in a "whack a mole" type game in which the player strikes a striking target each time it pops up. When the stress relieving device 410C is activated, a game of whack-a-mole may begin in which the player tries to strike as many of the striking targets as possible within a defined period of time. The player may be awarded a prize, such as a credit, a free game, reward points, or other item of value for playing the game and/or for achieving a target score.

Figure 9:
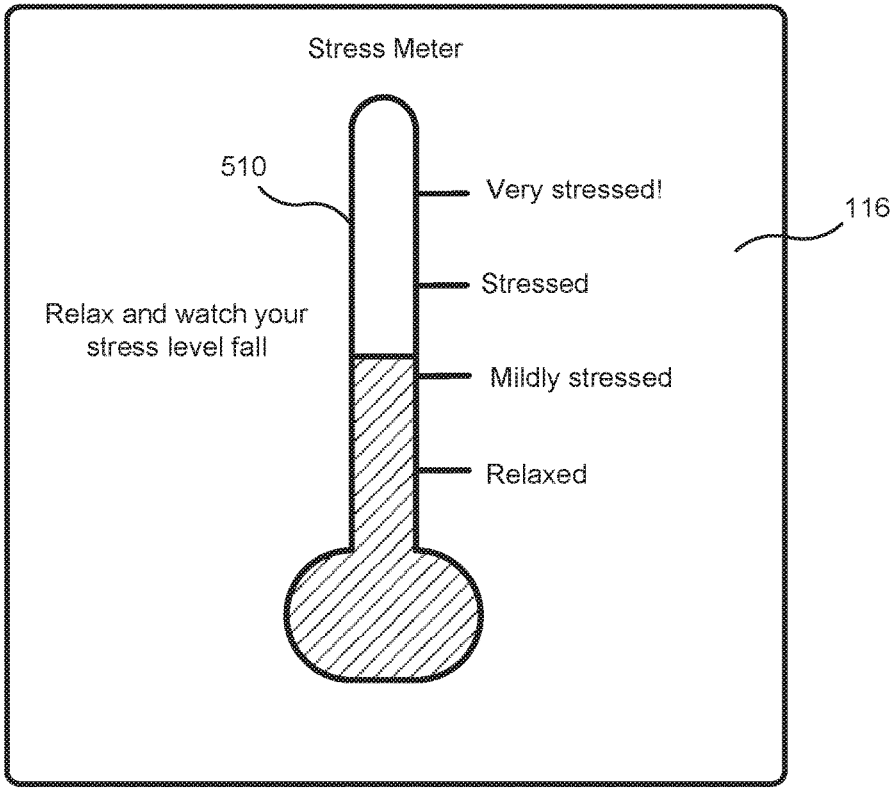
FIG. 9 illustrates a screen shot of a stress relieving game according to some embodiments.

In some embodiments, when the stress relieving feature is activated, the player may be invited to play a secondary stress relieving game on the EGM 100 that is different from the primary game. That is, when the stress relieving feature is activated, the primary wagering game may be suspended, and the player may be prompted to play a new stress relieving game. The stress relieving game may not be a wagering game, but the player may win a prize, such as a credit, a free game, reward points, or other item of value, for playing the stress relieving game. In some embodiments, the stress relieving game uses bio-feedback to reduce the stress level of the player. For example, FIG. 9 illustrates a screen shot of a biofeedback based stress relieving game that may be displayed on the primary display 116 or secondary display 118 of an EGM 100 in which the object of the game is to lower the temperature reading on a virtual thermometer 510 displayed on the screen. The temperature level displayed on the virtual thermometer 510 may be related to the player stress metric. The player is invited to engage a biometric sensor 162 (FIG. 1A), such as by grasping a handle or joystick 164 that includes sensor electrodes thereon. The EGM 100 may repeatedly recalculate the player stress metric, and as the player stress metric decreases, the level of the temperature reading on the thermometer 510 may fall. The virtual thermometer 510 may have a plurality of gradations, which may be percentages, arbitrary numbers, stress levels (e.g., "very stressed," "stressed," "mildly stressed," "relaxed," etc.) or other indicators. As the player stress level falls and the temperature reading consequently falls below the gradations, the EGM 100 may provide positive feedback to the player to encourage the player to relax further, such as by displaying or playing encouraging messages to the player, providing the player with rewards, such as credits, free games, and/or reward points, etc.

Once the player stress metric has fallen to a predetermined level and/or by a predetermined amount, the EGM 100 may switch back to the primary wagering game and allow the player to continue playing.

Further Definitions and Embodiments

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments and, although specific terms are employed, they are used in a generic and descriptive sense only and not for purposes of limitation, the scope of the inventive concepts being set forth in the following claims.

What is claimed is:

1. A method of operating a gaming machine, comprising:

receiving a deposit of wagering credits from a player;

determining a threshold stress level for the player;

initiating a gaming session, wherein the gaming session comprises a plurality of plays of a primary game on the gaming machine, wherein in at least one of the plurality of plays of the primary game, the gaming machine receives a wager by the player from the wagering credits;

measuring, by a biometric sensor, a physiological condition of the player;

monitoring a performance of the player in the gaming session;

generating a player stress metric in response to the physiological condition of the player and the performance of the player in the gaming session, wherein the player stress metric is indicative of a stress level of the player;

comparing the player stress metric to the threshold stress level; and in response to the player stress metric exceeding the threshold stress level, activating a stress relief feature of the gaming machine to allow the player to relieve stress.

2. The method of claim 1, wherein the physiological condition comprises a skin temperature of the player, a pulse rate of the player, a breathing rate of the player, a skin conductivity of the player and/or a blood oxygen level of the player.

3. The method of claim 1, wherein monitoring performance of the player comprises monitoring monetary gains or losses of the player, a total number of wins and losses of the player, and/or a number of losses in a row by the player.

4. The method of claim 1, wherein determining the threshold stress level for the player comprises obtaining a baseline stress level for the player and calculating the threshold stress level in response to the baseline stress level.

5. The method of claim 1, wherein determining the threshold stress level for the player comprises obtaining the threshold stress level from a player tracking server based on player tracking information provided by the player.

6. The method of claim 1, wherein the stress relieving relief feature comprises a striking target, and wherein activating the stress relief feature comprises prompting the player to physically hit the striking target.

7. The method of claim 6, wherein the striking target comprises a sensor to detect when the player strikes the striking target, the method further comprising:

detecting that the player has struck the striking target.

8. The method of claim 1, further comprising:

determining whether or not the player has utilized the stress relief feature; and in response to determining that the player has not utilized the stress relief feature, terminating the gaming session.

9. The method of claim 1, further comprising:

determining whether or not the player has utilized the stress relief feature; and in response to determining that the player has utilized the stress relief feature, awarding a prize to the player.

10. The method of claim 1, wherein the stress relieving feature comprises a secondary game.

11. The method of claim 10, further comprising collecting biofeedback data indicative of a stress level of the player as part of the secondary game, wherein an outcome of the secondary game is based at least in part in response to the biofeedback data indicating a reduction in the stress level of the player.

12. The method of claim 11, further comprising calculating the player stress metric as part of the secondary game wherein the reduction in the stress level of the player is determined in response to a reduction in the player stress metric.

13. A gaming machine comprising:

a processor;

a display device;

an input device;

a biometric sensor to measure a physiological condition of the player; and a memory device storing a plurality of instructions which, when executed by the processor, cause the processor to operate with the display device and the input device, for a play of a wagering game, to:

receive a deposit of wagering credits from a player;

determine a threshold stress level for the player;

initiate a gaming session, wherein the gaming session comprises a plurality of plays of a primary game on the gaming machine, wherein in at least one of the plurality of plays of the primary game, the gaming machine receives a wager by the player from the deposited wagering credits;

determine a physiological condition of the player measured by the biometric sensor;

monitor a performance of the player in the gaming session;

generate a player stress metric in response to the physiological condition of the player and the performance of the player in the gaming session, wherein the player stress metric is indicative of a stress level of the player;

compare the player stress metric to the threshold stress level; and in response to the player stress metric exceeding the threshold stress level, activate a secondary game of the gaming machine.

14. The gaming machine of claim 13, further comprising a sensor to collect biofeedback data indicative of a stress level of the player, wherein the player stress metric is generated in response to the biofeedback data.

15. The gaming machine of claim 13, wherein the processor monitors performance of the player by monitoring monetary gains or losses of the player, a total number of wins and losses of the player, and/or a number of losses in a row by the player.

16. The gaming machine of claim 13, wherein the processor determines the threshold stress level for the player by obtaining a baseline stress level for the player and calculating the threshold stress level in response to the baseline stress level.

17. The gaming machine of claim 13, wherein the secondary game comprises a striking target, and wherein the processor prompts the player to physically hit the striking target.

18. The gaming machine of claim 17, wherein the striking target comprises a sensor to detect when the player strikes the striking target.

19. The gaming machine of claim 13, wherein the secondary game collects biofeedback data indicative of a stress level of the player as part of the secondary game, wherein an outcome of the secondary game is based at least in part in response to the biofeedback data indicating a reduction in the stress level of the player.

20. A gaming machine comprising:

a processor;

a display device;

an input device; and a memory device storing a plurality of instructions which, when executed by the processor, cause the processor to operate with the display device and the input device, for a play of a wagering game, to:

receive a deposit of wagering credits from a player;

determine a threshold stress level for the player;

initiate a gaming session, wherein the gaming session comprises a plurality of plays of a primary game on the gaming machine, wherein in at least one of the plurality of plays of the primary game, the gaming machine receives a wager by the player from the deposited wagering credits;

monitor a performance of the player in the gaming session;

generate a player stress metric in response to the performance of the player in the gaming session, wherein the player stress metric is indicative of a stress level of the player;

compare the player stress metric to the threshold stress level; and in response to the player stress metric exceeding the threshold stress level, activate a secondary game of the gaming machine.

* * * * *